United States Patent [19]

Berry et al.

[11] 4,083,539

[45] Apr. 11, 1978

[54] OXYGEN LANCE ASSEMBLY

[75] Inventors: William W. Berry, Pittsburgh; Leo L. Meinert, Beaver; Nicholas M. Rymarchyk, Pittsburgh, all of Pa.

[73] Assignee: Pullman Berry Company, Harmony, Pa.

[21] Appl. No.: 795,243

[22] Filed: May 9, 1977

[51] Int. Cl.[2] ..... C21C 5/32

[52] U.S. Cl. ..... 266/225

[58] Field of Search ..... 266/225, 226; 239/132.3

[56] References Cited

U.S. PATENT DOCUMENTS 3,972,515 8/1976 Mercatoris ..... 266/225

*Primary Examiner*—Gerald A. Dost

*Attorney, Agent, or Firm*—Thomas G. Anderson

[57] ABSTRACT

A steelmaking oxygen lance assembly includes a top support member having oxygen and water inlet and outlet pipes. The support member includes a connector plate assembly provided with slots communicating with the pipes. A second connector plate assembly with similar slots is clamped to the first connector plate by quick releasable securing members with the slots in registry. The support head includes an upper oxygen pipe that projects downwardly into a sleeve supported on the second connector plate assembly to provide a slip joint.

A lower oxygen pipe on the second connector plate assembly includes an upper enlarged tubular portion in sliding engagement with the sleeve with a lower enlarged portion of the upper oxygen pipe. The arrangement includes a vent chamber in the slip joint and positive venting through the second connector plate assembly.

14 Claims, 8 Drawing Figures

OXYGEN LANCE ASSEMBLY

CROSS-REFERENCE TO RELATED PATENT APPLICATIONS

The instant patent application is related to the following five co-pending patent applications which were filed in the Patent Office on the same date as the instant application:

Ser. No. 795,244, filed May 9, 1977
Ser. No. 795,245, filed May 7, 1977
Ser. No. 795,247, filed May 9, 1977
Ser. No. 795,248, filed May 9, 1977
Ser. No. 795,246, filed May 9, 1977

BACKGROUND OF THE INVENTION

1. Field of the Invention

The invention relates to lances for use in steelmaking operations. More specifically it relates to an oxygen lance for use in a basic oxygen steelmaking furnace.

2. Description of the Prior Art

Patents of the prior art include U.S. Pat. Nos. 3,620,455 Nov. 16, 1971; 3,827,632 Aug. 6, 1974; 3,912,244 Oct. 14, 1975; RE: 28,769 Apr. 13, 1976 and 3,972,515 Aug. 3, 1976. The present invention is an improvement over these patents.

SUMMARY OF THE INVENTION

The present invention relates to an improved oxygen steelmaking lance which can easily be disconnected from its top support member for changeover of the lance so that only a single lance support carriage is required. The support member includes a first connector plate assembly which is provided with a plurality of openings in communication with the oxygen, water inlet and outlet pipes provided on the support member. The first plate assembly includes a lower flat surface. A second connector plate assembly is clamped to the first connector plate assembly by means of a pair of hinged bolts on the upper support which engage outwardly projecting ears provided on the second connector plate assembly. By merely loosening up the nuts on the bolts and swinging them outwardly the second connected plate assembly can be disconnected and by reverse procedure can be connected. The second connector plate assembly also includes an upper flat plate surface having openings which when the surfaces are clamped together provide for registry of the openings. The openings are slots of generally arcuate shape disposed in circumferentially spaced relation in radially spaced rows from a central oxygen opening. Each slot is spaced from an adjacent slot by a solid portion of the plate assembly thus forming a number of circumferentially spaced radially extending webs. One of the flat surfaces of the plate assemblies is provided with annular grooves radially spaced between the slots, the same containing O-rings for effectively sealing one row of slots from the other rows and the central oxygen opening.

The lower connector plate assembly which comprises the upper flat plate includes an integral downwardly projecting sleeve. The oxygen pipe of the top support member projects downwardly through the central opening of the upper connector plate assembly and is provided at its lower end with an enlarged circumferential shoulder. The lower end of the oxygen tube projects through the flat surface of the second connector plate into the sleeve and is in relative sliding engagement with the upper end of a lower oxygen pipe.

The lower oxygen pipe upper end includes an enlarged tubular portion which is disposed about and in telescoping engagement with the circumferential shoulder of the upper oxygen pipe. The enlarged tubular portion is also in telescoping sliding engagement with the inner wall surface of the sleeve.

The arrangement provides for an upper slip joint adjacent the connection of the upper and lower connector plate assemblies.

The lower connector plate assembly supports the lower oxygen pipe and includes water inlet and outlet pipes providing for passages which communicate with the aligned or registering slots of the connector plate assemblies.

The slip joint connection provided by the oxygen pipes and sleeve include double O-ring seals which effectively seal the slip joints. Between the sleeve and the oxygen pipes a vent chamber is provided which communicates with vent passages provided in the flat plate portion of the sleeve. The vent passages are disposed specifically in the radially disposed outwardly extending webs provided between the arcuate slots. The upper connector plate is also provided with a peripherally downwardly extending flange overlapping the plate of the lower connector plate assembly. This arrangement assures proper alignment of the plates in clamping relation. The peripheral flange is also provided with openings communication with the vent passages to provide for communication with the atmosphere.

DESCRIPTION OF THE PREFERRED EMBODIMENT

Figure 1:
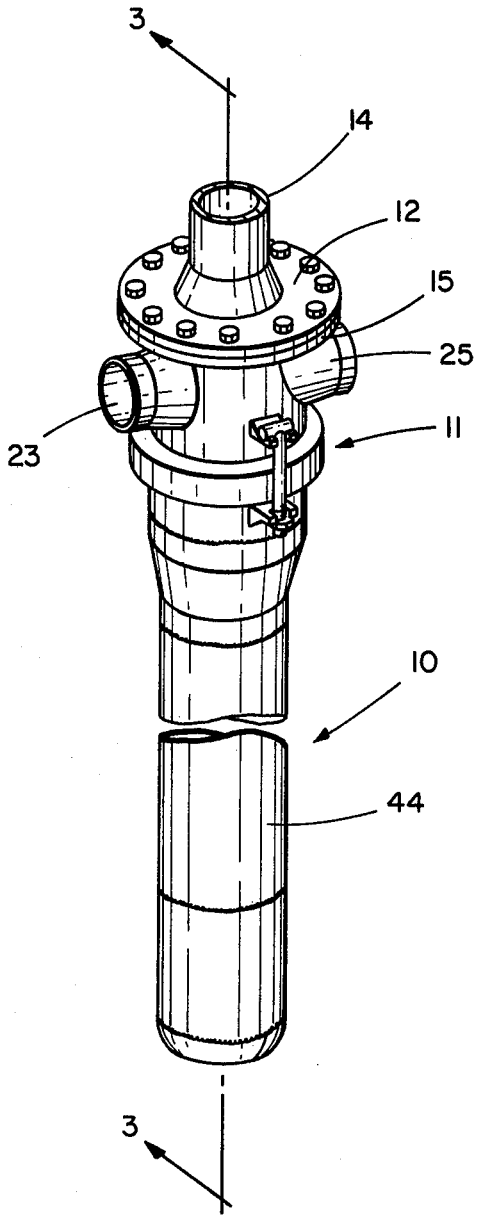
FIG. 1 is a perspective view of an improved oxygen lance.
Figure 2:
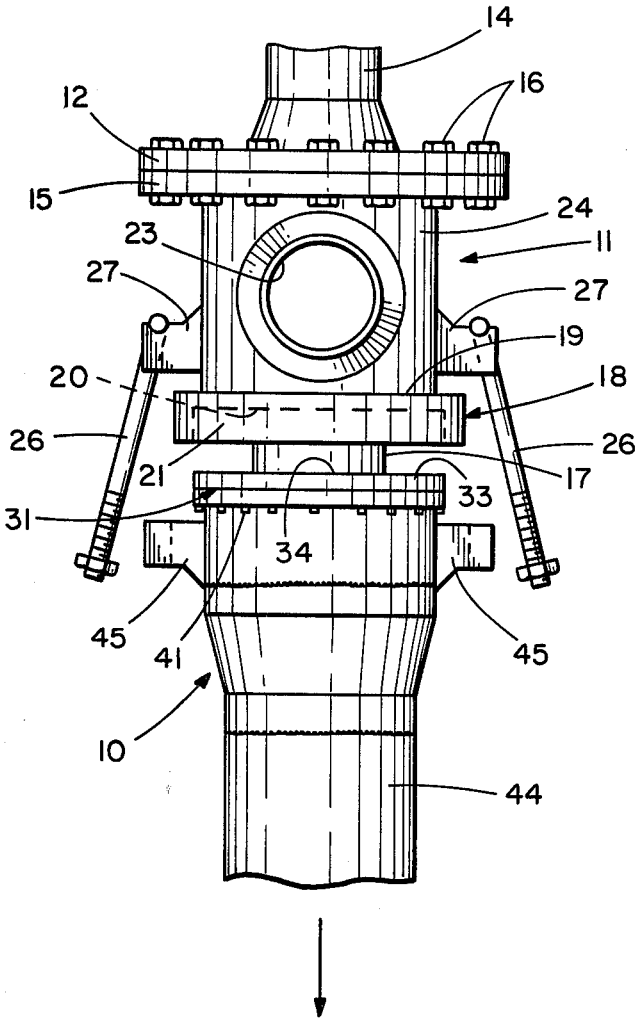
FIG. 2 is a side elevational view of the upper portion of an oxygen lance disclosing an improved connect and disconnect arrangement.
Figure 3:
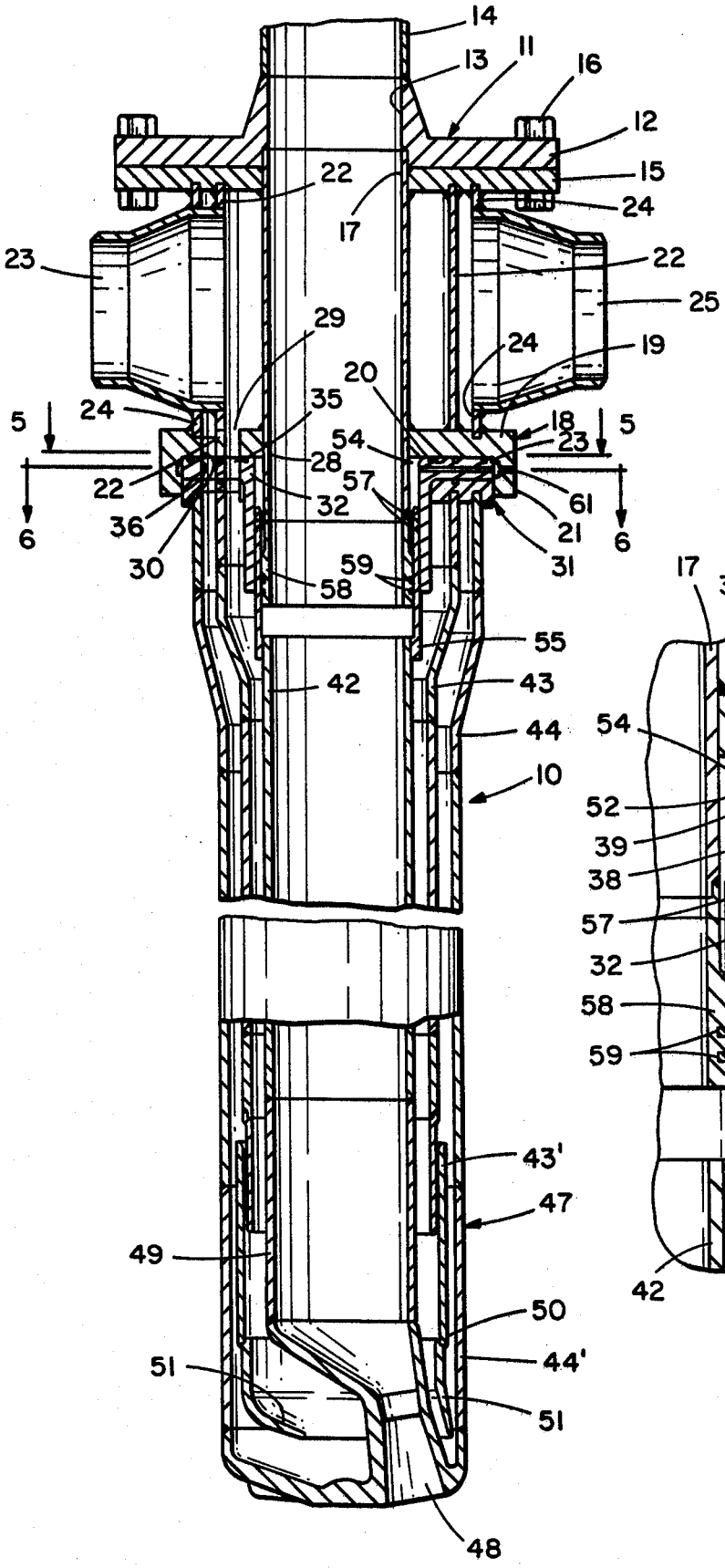
FIG. 3 is a cross-sectional view taken along the line 3—3 of FIG. 1.

FIGS. 1 and 3 disclose an improved lance 10 comprising a top support or head 11 including a top plate 12 having an opening 13 connected to an oxygen supply source or pipe 14. A second top plate 15 is connected to the top plate 12 by means of bolt and nut fasteners 16. A first oxygen pipe 17 communicates with the supply source pipe 14 through the plate 15.

A first upper connector plate assembly 18 includes a plate 19 having a lower flat surface 20 and a downwardly extending peripheral flange 21. The plate assembly 19 and top plate 15 have connected thereto a second pipe 22, to which a second water inlet connector 23 is connected. A third water outlet pipe 24 is disposed outwardly of the second pipe and communicates a water outlet connection 25.

A quick connect and disconnect clamping arrangement includes a pair of hinged bolts 26 hingedly suspended from outwardly projecting bosses 27 provided on the third pipe 24.

The plate 19 of the first connector plate assembly 18 includes a central oxygen opening 28 through which the first oxygen pipe 17 projects. The plate 19, as best shown in FIG. 3, includes slots or first openings 29 and 30 which are of arcuate shape, disposed in radially spaced rows to register with slots in the lower connector plate assembly to be described. The slots 29 communicate with the water inlet connection 23 and second water inlet pipe 22. The slots 30 communicate with the third water outlet pipe 24 which communicates with the water outlet connection 25.

Figure 5:
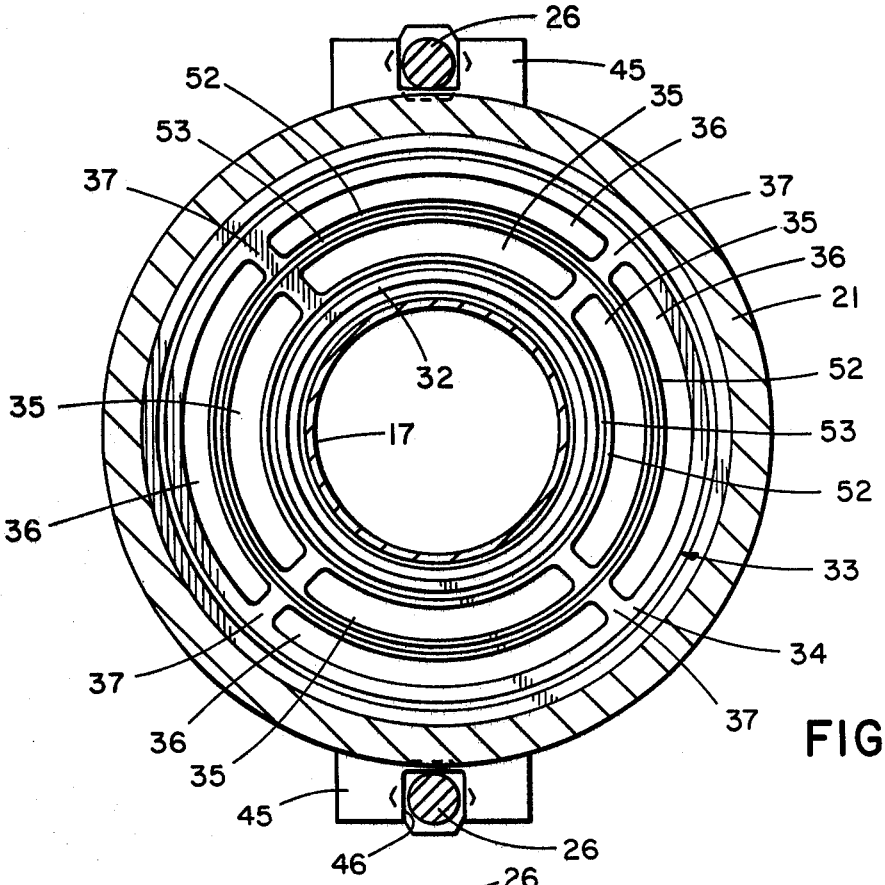
FIG. 5 is a cross-sectional view taken along the line 5—5 of FIG. 3.
Figure 6:
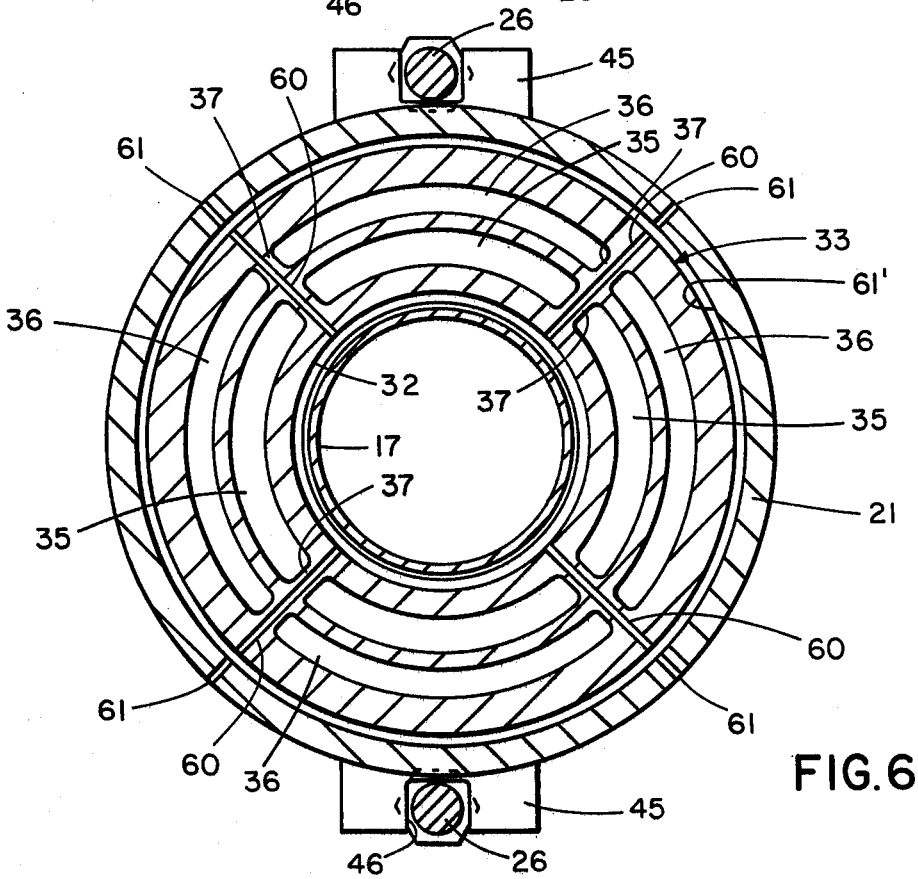
FIG. 6 is a cross-sectional view taken along the line 6—6 of FIG. 3.

A second or lower connector plate assembly is designated at 31 and includes a sleeve 32 having an annular flange or plate 33 provided with an upper annular flat surface 34. The flat surface 34 is provided with two rows of circumferentially disposed second slots 35 and 36 relatively radially spaced with respect to each other. The definition of "circumferentially spaced" as used in this description is meant to include that the slots are spaced in a circle or annulus, and that they are also disposed inwardly from the outer circumference of the lance. The slots are of arcuate shape and adjacent ends of the slots 35 and 36 provide solid radially extending circumferentially spaced solid webs 37 as best shown in FIGS. 5 and 6 which separate the adjacent slots.

Figure 4:
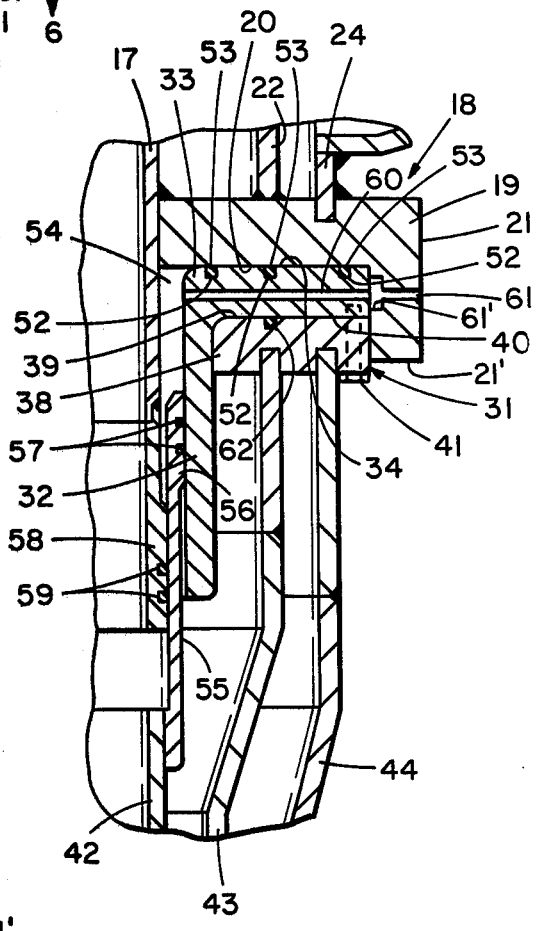
FIG. 4 is an enlarged cross-sectional view of the connection of an upper and lower connector plate assembly and a slip joint and venting arrangement.

As best shown in FIG. 4, a ring plate 38 having a flat upper surface 39 conforms to the lower flat surface 40 of the plate or flange 33 and is connected thereto by screws 41.

The second connector plate assembly 31 supports a fourth oxygen pipe 42, a fifth water inlet pipe 43, and a sixth water outlet pipe 44.

The water outlet pipe 44 has connected thereto wing projections 45 provided with slots 46 for receiving the bolt clamping members 26 in securing relation.

The pipes 42, 43 and 44 extend downwardly and are connected to a lance nozzle designated at 47. The nozzle 47 of the present design includes a discharge orifice 48 communicating with a stub extension pipe 49 communicating with the oxygen pipe 42. The nozzle also includes a water outlet stub pipe 44' connected to the pipe 44. It also includes a stub pipe 43' connected to the lower end of pipe 43 to provide a mechanical slip joint therewith. As indicated at 50, Baffle walls 51 are connected to the lower ends of the stub pipe 43' to direct the incoming water from the inlet to the outlet pipes.

The present invention is particularly directed to the arrangement of the sealing and venting arrangements disclosed.

As best shown in FIG. 4 and 5 the flat surface is provided with ring shaped grooves 52 within which seals in the form of O-rings 53 are secured. The O-rings 53 effectively seal the water inlet and water outlet passages from one another at the connection of the flat surfaces of the connector plate assemblies. At atmospheric or zero pressure vent space or annular chamber 54 is provided by the sleeve 32 and the outer wall of the first oxygen pipe 17. The innermost O-ring 53 seals this space 54 from the water inlet slots 29 and 35; however, in the event water should seep past the innermost O-ring 53, it will be safely vented from the lance.

The sleeve 32 projects downwardly and the lower oxygen pipe 42 is provided at its upper end with an enlarged diameter tube or second sleeve 55 which at its upper end has a further enlarged outer diameter portion 56 which supports two vertically spaced O-rings 57 in sliding sealing contact with the inner wall of the sleeve 32.

The lower end of the first oxygen pipe 17 is provided with an enlarged outer diameter portion, or piston like element 58 having two O-rings 59 vertically spaced relatively and in sliding, sealing, and telescoping relation with the inner wall of the second sleeve 55.

As best shown in FIG. 3, 4, 5 and 6, vent bores or passages 60 are provided in the webs 37 and project radially horizontally outwardly. The peripheral flange 21 is provided with outlet bores 61 communicating with the passages 60 and the atmosphere. It should be noted that the bores 61 are shown to extend radially; however, they may extend downwardly to vent through the lower surface 21' of the peripheral flange 21.

The ring 38 and upper surface 39 also include a cylindrical O-ring 62.

THE OPERATION OF THE PREFERRED EMBODIMENT

The operation of the lance disclosed is conventional in that oxygen supplied from the supply pipe 14 flows downwardly through pipe 42, stub pipe 49 and through one or more discharge orifices 48 into a basic oxygen furnace vessel. Water flows from the water inlet connection 23 through arcuate passages 29 and 35 downwardly along pipe 43 to the lower end of the nozzle 47 to cool the same whereupon it is directed upwardly along pipe 44 through the slots 30 and 36 outwardly through the water outlet connection 25. Thus the lance nozzle is effectively cooled.

The present invention resides in the quick disconnect and connect feature afforded by the first and second connector assemblies with their unique disposition of the arcuate aligned slots when the assemblies are connected together in clamping relation. The unusual disposition of the O-rings in the flat contacting surfaces of the connector plates assures the positive sealing required to provide a quick clamp type disconnect arrangement. Thus the support assembly to which the upper connector plate assembly is attached can remain in place on the support carriage which is provided adjacent a B.O.F. vessel and a lance can be replaced or interchanged within a short period. The support head can be used over and over again with new or repaired assemblies. The lance of the present design can be of shorter length and thus is easier to handle and transport.

The present sealing arrangement and venting assures the continued operation without interruption of the oxygen blowing process. In disassembly of the lower connector plate from the upper, it is a simple matter to disconnect the same.

Upon disconnection the sleeve can readily be replaced by merely loosening the cap screws 41 and inserting a new sleeve. This assures interchangeability of parts and eliminates oversizing the O-ring piston in the event of damage, and also the O-ring is easily replaced.

The arrangement of the sleeve 32 with the upper and lower oxygen pipe slip joint arrangement also provides an effective connection, to absorb the telescoping sliding movement of the pipes during expansion and contraction caused by high temperature variations.

THE MODIFIED EMBODIMENT

Figure 7:
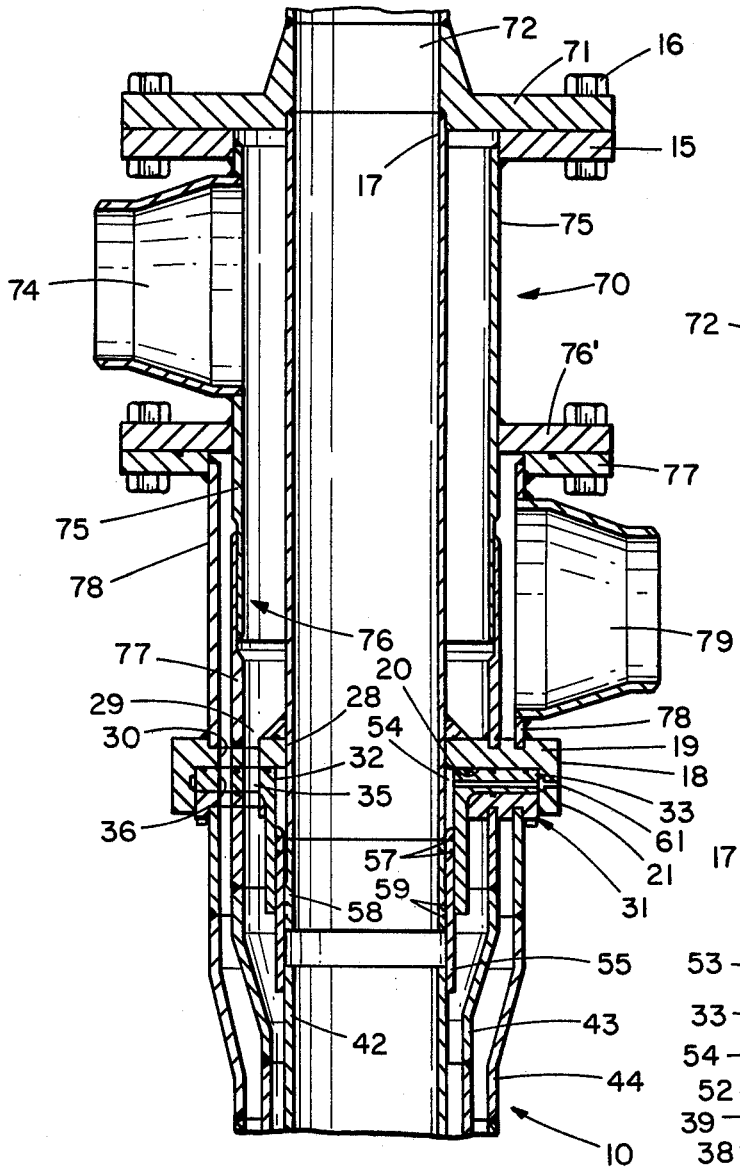
FIG. 7 is similar to FIG. 3 but showing a modified top support arrangement.
Figure 8:
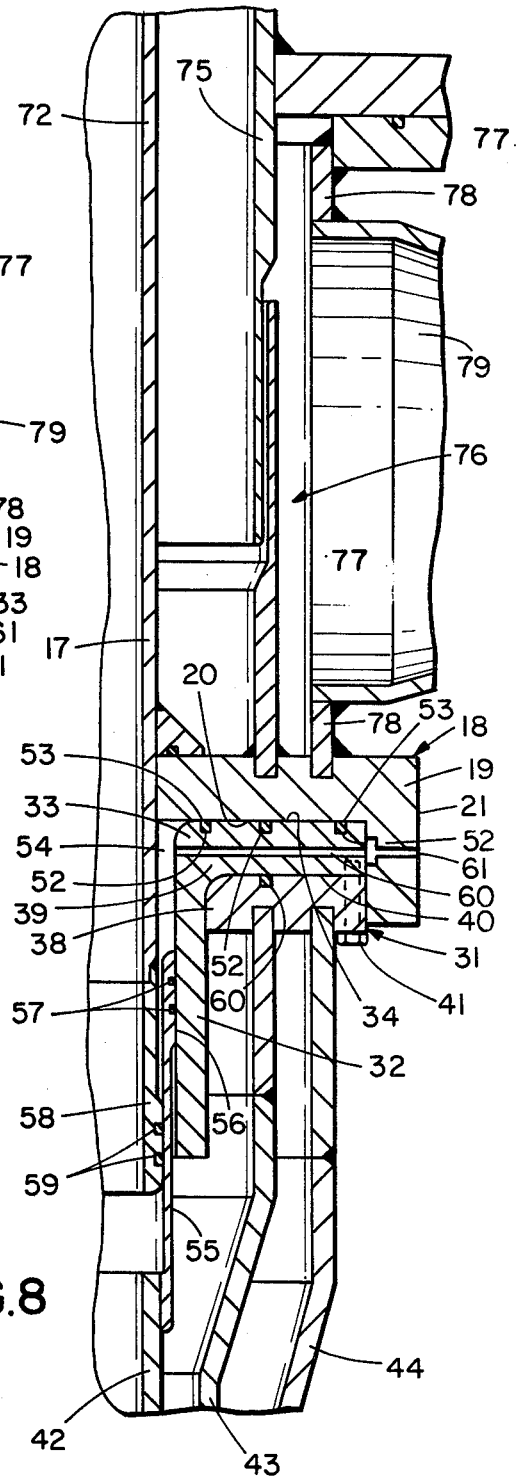
FIG. 8 is an enlarged cross-sectional view of the modified embodiment shown in FIG. 7.

FIG. 7 and 8 disclose a modified top support arrangement. Wherever the parts are the same as disclosed in the preferred embodiment the same reference characters are utilized.

In the modification a top support 70 includes an upper plate 71 having an oxygen inlet connection to which the oxygen pipe 17 (more elongated) is connected. A ring or flange 73 is connected to the plate 70 by means of bolts and nuts (not shown). A water inlet connection 74 is connected to an inlet water pipe 75. The inlet water pipe 75 has connected thereto a ring plate 76 to which is connected a connector ring 77 by suitable bolts and nuts (not shown). The water pipe 75 has a slip joint connection 76 with a short water pipe section 77 to accommodate temperature differentials between incoming and outgoing cooling water to prevent the development of excessive internal stresses. The short pipe section 77 is connected to the first connector plate assembly 18 and communicates with the arcuate slots 29 and 35. An outlet pipe 78 is also connected to the first upper connector plate assembly 18. A water outlet connection 79 discharges water from the outlet pipe 78.

The operation of the modification is similar to the preferred embodiment the primary difference being the vertical offset of the water inlet and outlet connections as well as the mechanical slip joint arrangement 76 which may be desired in some applications.

The unique sealing arrangement and the venting assemblies are similar and the same advantages as enumerated before are achieved.

In both embodiments, water cannot leak into the oxygen pipes, nor can oxygen leak into the water pipes.

What is claimed is:

1. A steelmaking lance assembly comprising a top support member, said support member including a first central oxygen supply pipe and second and third water inlet and outlet pipes concentric with said first pipe, a first connector plate assembly on said top support member, said first pipe being connected to said first connector plate assembly and projecting downwardly with respect thereto, said first connector plate assembly having a lower flat surface including a plurality of first openings communicating with said second and third pipes, a second connector plate assembly, said second connector plate assembly including a sleeve member having a flange including a flat upper surface having a plurality of second openings adapted to register with said first openings, a fourth oxygen pipe concentric with said first pipe and including an upper end portion adapted to engage said sleeve member in relative telescoping relation, first sealing means between said upper end portion and said sleeve, said first pipe projecting into said upper end portion of said fourth oxygen pipe, second sealing means between said first pipe and said upper end portion of said fourth pipe, fifth and sixth water inlet and outlet pipes concentric with said fourth pipe, connected to said second connector plate assembly and communicating with said second openings, a lance nozzle connected to said pipes including an outlet orifice and water chamber, and means quick releasably connecting said first and second connector plate assemblies and flat surfaces in clamped relation with their positioned openings in registry and in communication.

2. The invention in accordance with claim 1, said first and second spaced openings comprising a plurality of individual circumferentially positioned arcuately shaped slots, and first and second connector plate assemblies including web portions circumferentially spaced and separating adjacent ends of said slots.

3. The invention in accordance with claim 2, said first and second circumferential openings of said connector plate assemblies, each being disposed in radially spaced pairs.

4. The invention in accordance with claim 1, said first and second spaced openings comprising a plurality of individual arcuately shaped slots each of said connector plates including a pair of such slots in radially spaced relative relation, one of said connector plates having a plurality of registering annular recesses adjacent to and between said slots in said flat surfaces, and ring type seals in said recesses.

5. The invention in accordance with claim 1, said flat surfaces of said connector plates including sealing means between said arcuately shaped slots.

6. The invention in accordance with claim 1, said first connector plate assembly including a second flange connected to the outer peripheral end of said first flange and extending downwardly in overlapping relation relative to said first flange.

7. The invention in accordance with claim 6, the upper end portion of said fourth oxygen pipe being vertically spaced from said first connector plate assemblies to provide a vent chamber, and a vent passage in said second flange providing for venting of said chamber to the atmosphere.

8. The invention in accordance with claim 7, said second flange including a second vent passage communicating with said first vent passage.

9. The invention in accordance with claim 1, said second connector plate assembly including a ring supported around said sleeve, said flange having a lower flat surface, and means releasably connecting said ring to said flat lower surface of said flange.

10. The invention in accordance with claim 9, said fifth and sixth inlet and outlet pipes being connected to said ring.

11. The invention in accordance with claim 1, said top support member including on one side thereof a water inlet connection communicating with said second water inlet pipe, and a water outlet connection in the same horizontal plane as said water inlet connection on another side of said top support member communicating with said third water outlet pipe.

12. The invention in accordance with claim 1, said top support member including on one side thereof a water inlet connection communicating with said second water inlet pipe, a second water outlet connection disposed below said first water outlet connection on another side of said top support member, said second water inlet pipe comprising lower and upper pipe sections positioned in relative telescoping relation.

13. The invention in accordance with claim 1, said top support member including a top attachment plate communicating with said first central oxygen supply pipe, a water inlet connection connected to said second inlet pipe, a second top attachment plate connected to said third outlet pipe below said water inlet connection and a water outlet connection on said third outlet pipe disposed below said second top attachment plate.

14. The invention in accordance with claim 13, said second water inlet pipe comprising two telescoping sections forming a slip joint therebetween.

* * * * *